US006851292B2

(12) United States Patent
Krühn

(10) Patent No.: US 6,851,292 B2
(45) Date of Patent: Feb. 8, 2005

(54) LOCK-KEY SYSTEM

(75) Inventor: Jürgen Krühn, Berlin (DE)

(73) Assignee: Ikon Aktiengesellschaft Präzisionstechnik, Berlin (DE)

( * ) Notice: Subject to any disclaimer, the term of this patent is extended or adjusted under 35 U.S.C. 154(b) by 0 days.

(21) Appl. No.: 10/343,061

(22) PCT Filed: Aug. 7, 2001

(86) PCT No.: PCT/DE01/02999

§ 371 (c)(1),
(2), (4) Date: Jan. 27, 2003

(87) PCT Pub. No.: WO02/12659

PCT Pub. Date: Feb. 14, 2002

(65) Prior Publication Data

US 2003/0164012 A1 Sep. 4, 2003

(30) Foreign Application Priority Data

Aug. 8, 2000 (DE) ..... 100 42 070

(51) Int. Cl.[7] ..... E05B 19/06
(52) U.S. Cl. ..... 70/409; 70/336; 70/405
(58) Field of Search ..... 70/409, 336–344, 70/405–407, 402, 394, 393

(56) References Cited

U.S. PATENT DOCUMENTS

| | | | | | |
|---|---|---|---|---|---|
| 4,368,629 | A | | 1/1983 | Prunbauer | 70/406 |
| 4,653,298 | A | * | 3/1987 | Tietz | 70/406 |
| 4,787,225 | A | * | 11/1988 | Hauser et al. | 70/401 |
| 4,964,288 | A | * | 10/1990 | Braun et al. | 70/406 |
| 5,715,717 | A | * | 2/1998 | Widen | 70/493 |
| 5,797,287 | A | * | 8/1998 | Prunbauer | 70/409 |
| 5,809,816 | A | * | 9/1998 | Widen | 70/493 |
| 5,845,525 | A | * | 12/1998 | Widen | 70/493 |
| 5,964,112 | A | * | 10/1999 | Stefanescu | 70/493 |
| 6,023,954 | A | * | 2/2000 | Field | 70/409 |
| 6,615,628 | B2 | * | 9/2003 | Lou | 70/409 |

FOREIGN PATENT DOCUMENTS

| | | |
|---|---|---|
| DE | 43 04 604 A1 | 8/1994 |
| EP | 0 261 298 A | 3/1988 |
| EP | 0 928 867 A | 7/1999 |

* cited by examiner

*Primary Examiner*—John B. Walsh
(74) *Attorney, Agent, or Firm*—Henry M. Feiereisen; Ursula B. Day

(57) ABSTRACT

The invention relates to a lock-key system comprising a flat key (1), which is insertable into the keyway of a cylinder core (3), wherein grooves (4) and ribs (5) inside the keyway are assigned to corresponding ribs (5*a*) and grooves (4*a*) located on both flat sides of the key (1), wherein the key is subdivided from the key spine (6) to the key facing into different profile sections. The middle profile section is assigned to at least one groove (4) on one outer surface of the keyway (2) and to a rib (5) on the opposite outer surface of the keyway. Both the groove (4) as well as the rib (5) comprise a flank (4', 5'), which extends perpendicular or substantially perpendicular to the center plane of the key or of the keyway, and comprise a flank (4", 5"), which extends slantingly to this center plane. The perpendicular or substantially perpendicular flank of the groove faces the opposite slanted flank of the rib, and the perpendicular or substantially perpendicular flank of the rib faces the opposite slanted flank of the groove.

4 Claims, 4 Drawing Sheets

LOCK-KEY SYSTEM

BACKGROUND OF THE INVENTION

The invention relates to a lock-key system including a flat key which is insertable in the keyway of a cylinder core, wherein grooves and ribs inside the keyway are assigned to ribs and grooves on both flat sides of the key, wherein the key is subdivided into different profile sections from the key spine to the key facing, with the section near the key spine configured as guide section and with the section near the key facing at least partially receiving the notches for the associated tumblers.

Designs for such flat keys or keyways are known in a wide variety. Examples include hereby EP 0 261 298 A2 or DE 43 04 604 C2.

Conventional lock cylinders with flat key and pin tumblers are "attacked"i.a. by "picking" with manual picking tools, picking guns or so-called electropick.

During picking procedure, the pin tumblers are brought into opening position by the suitable tool. By bracing the cylinder core in rotation direction, the tumblers are braced successively in opening position and held until all tumblers are open. This is implemented during manual picking quasi statically or dynamically when picking with the mechanical picking gun or the electropick are involved.

Various measures have been proposed to guard against unauthorized opening of lock cylinders with picking tools and—mostly in combination—used together. These measures involve. . .

particularly designed tumbler pins which interlock during "picking" with grooves or projections on the parting line between cylinder housing and cylinder core and prevent an "opening" by picking.

Particularly designed bores in cylinder core and/or cylinder housing for effecting during "picking" that the tumbler pins interlock therein and preventing an "opening"during picking as they do not reach without resistance the parting line between housing and core.

paracentric key profiles which inhibit the handling with picking tools.

Although all described measures generally make picking more difficult, they are unable to prevent picking in principle.

SUMMARY OF THE INVENTION

It is therefore the object of the invention to provide a lock-key system which, as far as possible, cannot be opened by picking.

In accordance with the invention, this object is attained in a key lock system by assigning in the middle profile section at least one groove on the one outer surface of the keyway to a rib on the opposite outer surface of the keyway, by providing the groove as well as the rib, on one hand, with a flank, extending perpendicular or substantially perpendicular to the center plane of the: key or keyway and, on the other hand, with a flank, extending slantingly to this center lane, and by positioning the perpendicular or substantially perpendicular flank of the groove in confronting relationship to the slanted flank of the rib and by positioning the perpendicular or substantially perpendicular flank of the rib in confronting relationship to the slanted flank of the groove. Before paragraph [0016], add the heading Preferred configurations are set forth in the sub-claims.

The keyway is subdivided in various sections which are arranged in offset relationship with respect to the centerline and paracentric.

This subdivision is known and is normally exploited for subdividing key profiles in order to separate the region for variation in lock assemblies: from a non-variable region.

Profiled channels configured in this way allow in some cases an opening of a cylinder by using a special picking tool at unfavorable tumbling combinations and with great skill. The configuration of keyways according to the invention is now characterized by a particular assignment of the flanks of the ribs and grooves in the middle profile section.

BRIEF DESCRIPTION OF THE DRAWING

Exemplified embodiments of the invention will now be described with reference to the drawings in which.

DETAILED DESCRIPTION OF PREFERRED EMBODIMENTS

Figure 1:
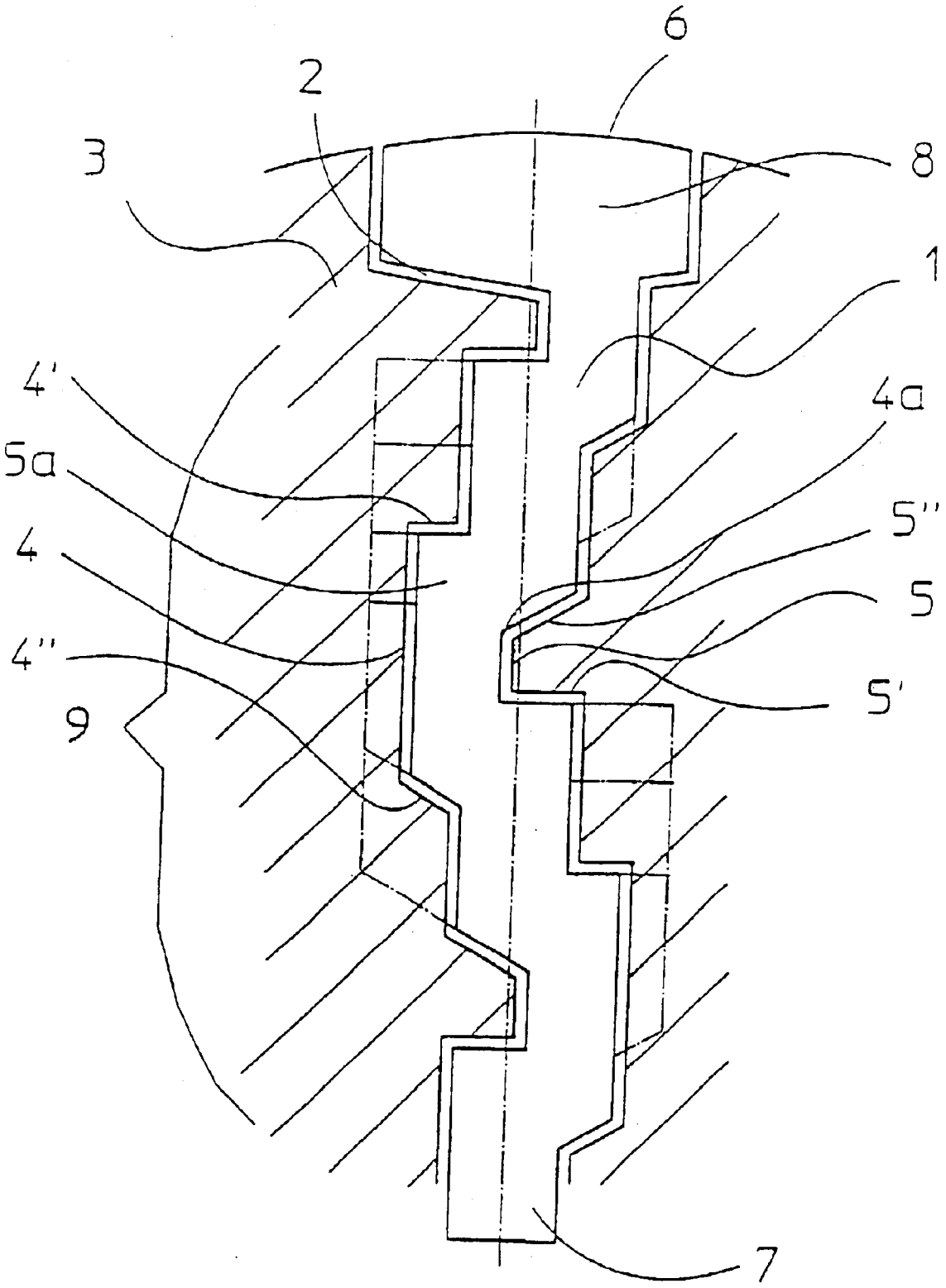
FIGS. 1 to 4 show cross sectional views through various embodiments of a key and respective cross sectional contours of the keyway.

In the drawings (FIGS. 1–4), the flat key is designated with 1 and the respective keyway is designated with 2. The surrounding cylinder core is indicated with 3. The section near the key spine 6 is configured as guide section 8, whereas the section in proximity of the key facing 7 has the notches—not shown here—for the interaction with the tumblers.

In the illustrated exemplified embodiment, the middle profile section 9 is provided in the keyway with grooves 4 and ribs 5 which, of course, are associated to respective ribs 5*a* and grooves 4*a* on the side surfaces of the flat key. The profile section is demarcated in one direction by vertical flanks 4' at the grooves 4 and 5' at the ribs 5, and in the other direction by slanted flanks 4" and 5".

Figure 2:
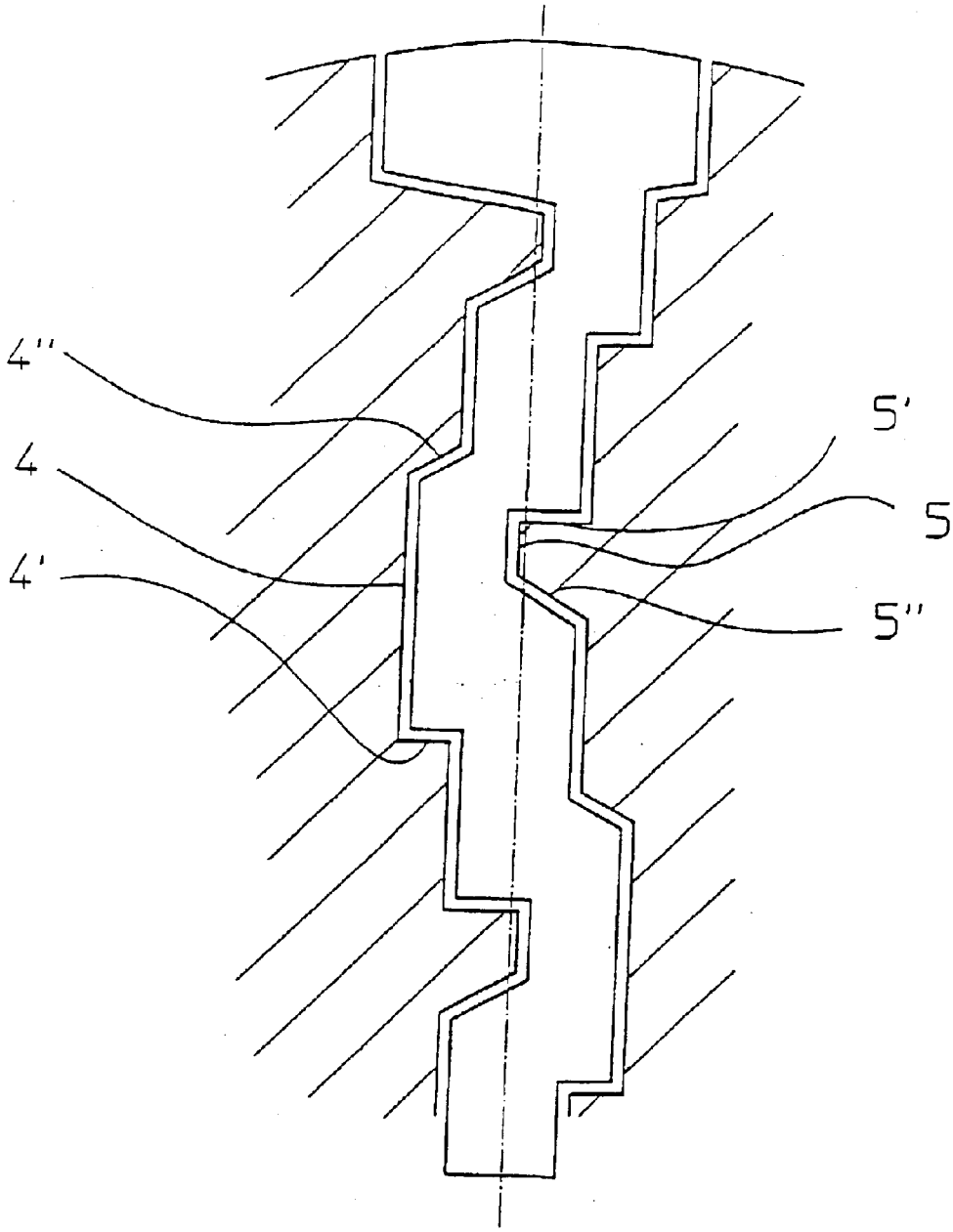

In the configuration illustrated in FIG. 2, the respective surfaces are disposed in reverse direction.

As a sequence, the tool can move during picking in one preferred direction and can possibly be deflected into the next profile section, while the motion is stopped, however, in the other direction (barb effect).

Figure 3:
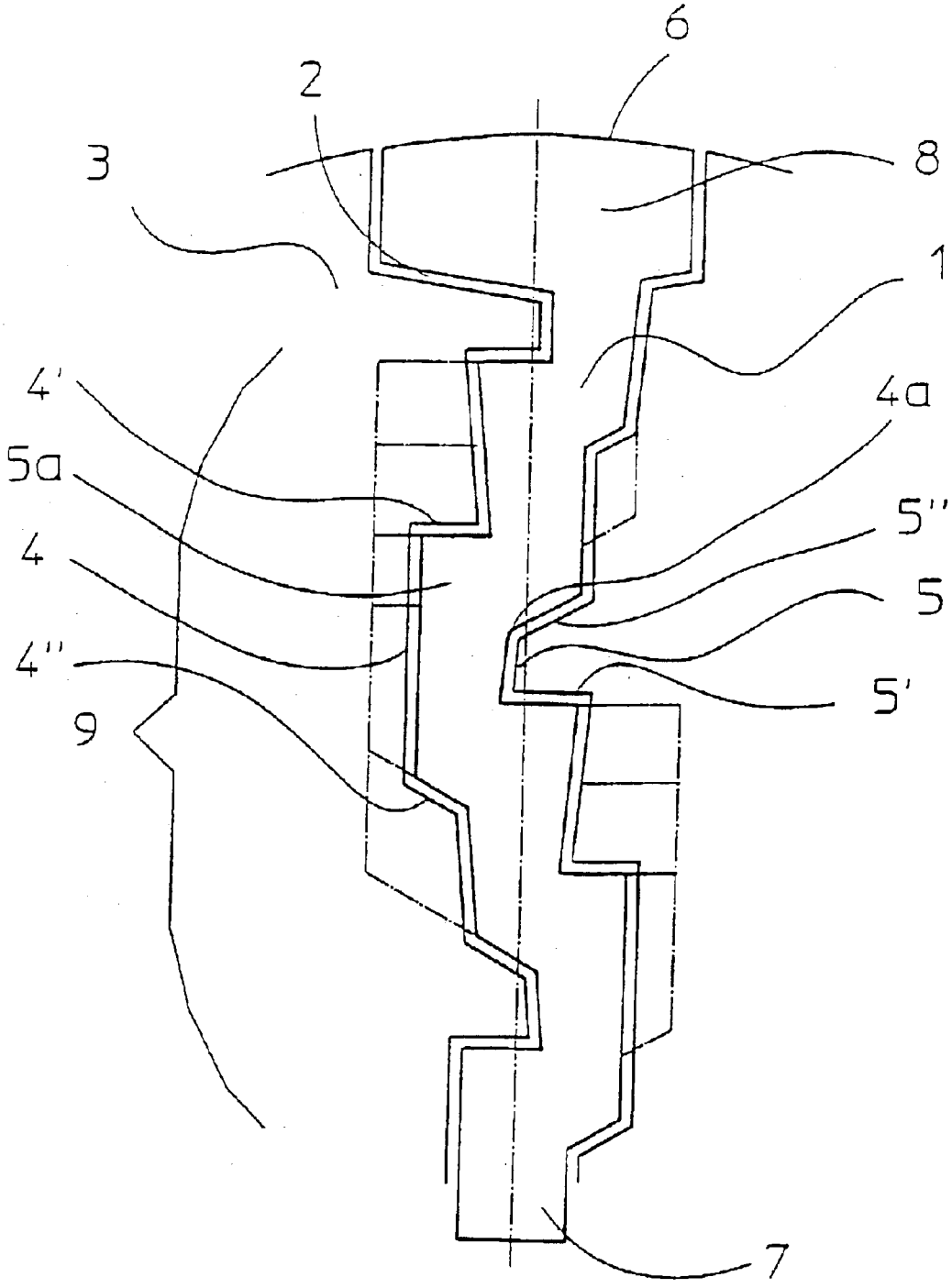
Figure 4:
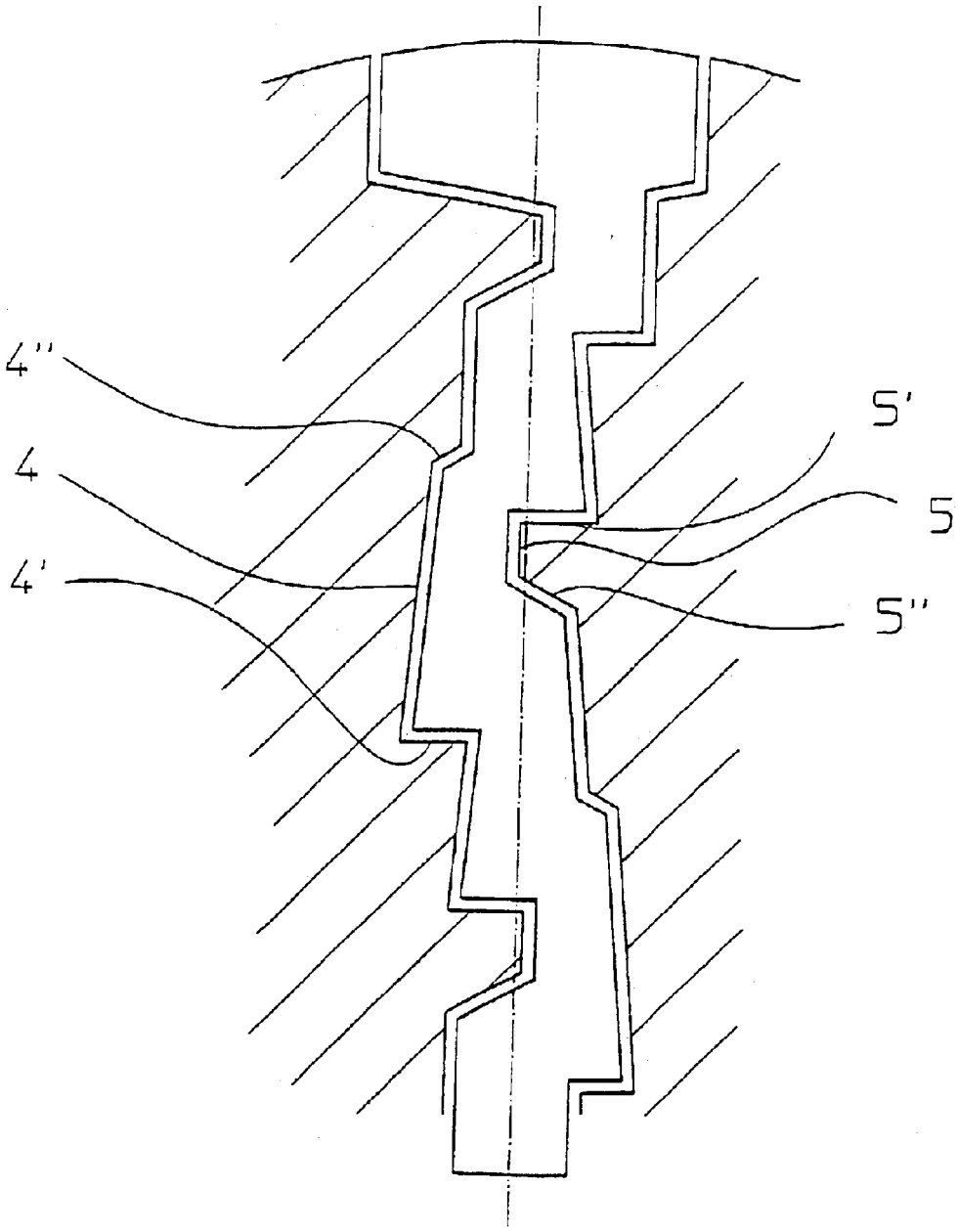

A further embodiment—as illustrated in FIGS. 3 and 4—includes a further taper of the profile sections in such a way that, when respectively dimensioned, the p. tool is wedged in one direction. As a result, the picking tool has less (or no) freedom of movement and picking is halted.

What is claimed is:

1. A key-lock system, comprising: a flat-sided key insertable into a keyway of a cylinder core, the keyway provided with grooves and ribs corresponding to ribs and grooves of the key, wherein the key and the key way are subdivided into different profile sections extending from a key spine to a key facing, wherein a middle profile section of the key is provided with at least one groove at one side of the keyway and assigned to a rib on an opposite side of the keyway, the grove and the rib each bordered at one end thereof with a flank extending substantially perpendicular to a center plane of the keyway, and at another end bordered by a flank extending slantingly to the center plane so that the substantially perpendicular flank of the groove is confronting relationship to the slanted flank of the rib and the substantially perpendicular flank of the rib is in confronting relationship to the slanted flank of the groove, and wherein at least one of the ribs project beyond a central axis of the keyway.

2. The key-lock system according to claim 1, wherein the key profile is configured paracentric.

3. The key-lock system according to claim 1, wherein the keyway tapers in direction of the slanted flanks.

4. The key-lock system according to claim 1, wherein the middle profile section is subdivided into several profile subsections which are demarcated—when viewed in a direction from the key facing to the key spine—by slanted flanks and, when viewed in a direction from the key spine to the key facing, are demarcated by substantially perpendicular flanks.

* * * * *